US011454038B2

(12) United States Patent
Rifkin

(10) Patent No.: US 11,454,038 B2
(45) **Date of Patent: *Sep. 27, 2022**

(54) MODULAR DISPLAY BOOTH ASSEMBLY THAT REQUIRES NO TOOLS

(71) Applicant: Josh Rifkin, Carlsbad, CA (US)

(72) Inventor: Josh Rifkin, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/519,763

(22) Filed: Nov. 5, 2021

(65) Prior Publication Data

US 2022/0064974 A1 Mar. 3, 2022

Related U.S. Application Data

(63) Continuation-in-part of application No. 16/543,517, filed on Aug. 17, 2019, now Pat. No. 11,172,771.

(60) Provisional application No. 62/765,464, filed on Aug. 27, 2018.

(51) Int. Cl.
*E04H 1/12* (2006.01)
*A47B 47/00* (2006.01)

(52) U.S. Cl.
CPC ..... *E04H 1/1272* (2013.01); *A47B 47/0091* (2013.01)

(58) Field of Classification Search
CPC ... A47F 5/101; A47B 47/0075; A47B 47/021; A47B 47/0091; A47B 57/34; A47B 57/48; A47B 57/30; E04H 1/1272; G09F 15/0068
See application file for complete search history.

(56) References Cited

U.S. PATENT DOCUMENTS 1,398,071 A * 11/1921 Forester ..... A47B 96/02 211/90.01
1,903,631 A * 4/1933 Morrison ..... A47B 3/12 108/150
2,213,115 A * 8/1940 Bales ..... A47B 57/16 108/109
2,354,269 A * 7/1944 Marchand ..... A47B 57/50 248/243

(Continued)

FOREIGN PATENT DOCUMENTS

CA 2198392 A1 * 9/1998
CH 425124 A * 11/1966

(Continued)

*Primary Examiner* — Stanton L Krycinski
(74) *Attorney, Agent, or Firm* — Eric Hanscom

(57) ABSTRACT

A modular display can be assembled and disassembled by one person without any tools. The structural parts of the assembly include several types of interlocking pieces which form stable columns, and various bridging devices, including a bridge shelf removably secured by bridge brackets, that allow for slatwall or pegboard to be easily inserted to display a wide range of products that merchandise on slatwall, pegboard, shelves, tables and free-standing pedestals as well as garment poles. This display booth emulates a retail shopping experience where physical products are sold on varying display mediums. The parts fit to together by inserting hooked tabs into slots that fit the width of the tabs. Since all the parts are interchangeable, the system allows for multiple configurations, as well as easy expansion of the display booth by adding more parts.

17 Claims, 19 Drawing Sheets

(56) References Cited

U.S. PATENT DOCUMENTS 2,366,677 A * 1/1945 Rosenthal ..... A47B 47/042 108/180
2,481,671 A * 9/1949 John ..... A47B 3/06 108/101
2,751,706 A * 6/1956 Metal ..... A63H 33/06 211/186
2,854,724 A * 10/1958 Wuorio ..... B28B 7/02 249/129
3,069,216 A * 12/1962 Vaeth ..... A47B 47/042 312/265.5
3,143,236 A * 8/1964 Haas ..... B65D 9/32 446/105
3,195,507 A * 7/1965 Miller ..... A01K 31/14 119/431
3,298,329 A * 1/1967 Carstens, Jr. ..... B65D 17/30 312/265.5
3,300,245 A * 1/1967 Rumble ..... A47B 3/12 297/440.13
3,331,514 A * 7/1967 Wouter ..... A47B 57/34 312/351
3,360,137 A * 12/1967 Novales ..... A47B 57/30 211/175
3,489,290 A * 1/1970 Charles ..... A47B 57/04 248/220.42
3,698,329 A * 10/1972 Diamond ..... A47B 96/06 108/42
3,730,601 A * 5/1973 Misenheimer, III ..... A47B 87/0215 108/190
3,759,191 A * 9/1973 Freeman ..... A47B 57/30 108/42
3,812,977 A * 5/1974 Glassman ..... A47B 47/0075 312/107
3,961,586 A * 6/1976 Bernard ..... A47B 96/06 211/187
4,153,311 A * 5/1979 Takahashi ..... A47B 47/042 312/265.5
4,372,086 A * 2/1983 Hanlon ..... E04B 2/7405 40/605
4,508,231 A * 4/1985 Honickman ..... A47B 57/34 D6/672
4,562,776 A * 1/1986 Miranda ..... A47B 47/042 108/190
4,807,539 A * 2/1989 Del Castillo von Haucke ..... A47B 57/00 312/265.5
4,832,421 A * 5/1989 Shoffner ..... A47B 47/042 312/265.5
4,928,833 A * 5/1990 Huizenga ..... A47B 95/008 211/187
4,951,925 A * 8/1990 Schultz ..... F16B 7/048 256/22
5,052,580 A * 10/1991 Khoury ..... B60R 7/02 220/551
5,335,753 A * 8/1994 Campbell ..... B25H 1/06 182/151
5,690,239 A * 11/1997 Ballard ..... A47F 5/106 211/187
5,819,958 A * 10/1998 Dement ..... A47B 95/008 211/90.04
6,079,803 A * 6/2000 West ..... A47B 61/02 211/186
6,283,564 B1 * 9/2001 Corson ..... A47B 17/006 312/196
6,532,878 B2 * 3/2003 Tidemann ..... A47B 47/042 108/186
6,595,378 B2 * 7/2003 Wang ..... A47B 47/0075 211/186
6,615,999 B1 * 9/2003 Culp ..... A47B 47/042 211/186
6,769,750 B2 * 8/2004 Hughes ..... A47B 47/042 312/265.5
6,845,871 B1 * 1/2005 Culp ..... A47B 47/042 211/186
7,114,300 B1 * 10/2006 Culp ..... A47B 47/042 211/186
7,798,338 B2 * 9/2010 Maheu ..... A47F 5/0815 211/94.02
7,975,860 B2 * 7/2011 Dittus ..... H05K 7/1489 211/207
D647,329 S * 10/2011 Ward ..... D6/675.3
8,079,315 B2 * 12/2011 Berent ..... A47C 4/021 108/180
8,458,980 B2 * 6/2013 Ivanov ..... A63H 33/084 446/105
8,662,326 B2 * 3/2014 Brick ..... A47B 47/042 211/186
9,282,816 B2 * 3/2016 Ahart ..... A47B 47/0041
9,346,391 B2 * 5/2016 Workman ..... B60R 11/06
9,370,243 B2 * 6/2016 Menard ..... A47B 47/0091
9,615,663 B2 * 4/2017 Davis ..... A47B 47/0075
9,981,677 B1 * 5/2018 Gross ..... B62B 3/025
10,058,173 B2 * 8/2018 Umstead ..... A47B 57/54
2006/0209815 A1 * 9/2006 Castro-Estevez ..... A47B 47/0075 370/379
2007/0228902 A1 * 10/2007 Frey ..... A47B 43/00 312/257.1
2008/0116159 A1 * 5/2008 Chu ..... A47F 5/101 211/85.26
2009/0120889 A1 * 5/2009 Cebollero ..... A47C 4/03 248/346.4
2009/0309464 A1 * 12/2009 Schwartz ..... A47B 47/042 312/107
2014/0263138 A1 * 9/2014 Koch ..... A47B 47/0075 211/195
2015/0144578 A1 * 5/2015 Maiden ..... A47B 47/025 211/26
2017/0258229 A1 * 9/2017 Siffel ..... B01L 9/00
2017/0360223 A1 * 12/2017 Rifkin ..... H05K 7/10

FOREIGN PATENT DOCUMENTS

DE 2201642 A1 * 8/1973
FR 1341438 A * 10/1963
FR 1423923 A * 1/1966
FR 1497484 A * 10/1967
FR 1551102 A * 12/1968
FR 2151592 A5 * 4/1973
FR 2638345 A1 * 5/1990
FR 2991859 A1 * 12/2013 ..... A47B 47/0075
FR 3001876 A1 * 8/2014 ..... A47B 47/0075
GB 295517 A * 8/1928
GB 334372 A * 9/1930
GB 996232 A * 6/1965
GB 1354720 A * 5/1974 ..... G09F 15/0068
GB 1334878 A * 6/1974
KR 20030076102 A * 9/2003
KR 20040038942 A * 5/2004
WO WO-0182748 A1 * 11/2001 ..... A47B 47/0075

* cited by examiner

MODULAR DISPLAY BOOTH ASSEMBLY THAT REQUIRES NO TOOLS

CROSS REFERENCE TO RELATED APPLICATIONS

This application claims priority to U.S. Provisional No. 62/765,464, filed Aug. 27, 2018, and to U.S. Utility patent application Ser. No. 16/543,517, filed Aug. 17, 2019, the contents of which are incorporated by reference into this application.

STATEMENT REGARDING FEDERALLY SPONSORED RESEARCH OR DEVELOPMENT

This invention was not federally sponsored.

FIELD OF THE INVENTION

The present invention is a system for erecting modular, weight-bearing walls, shelves, and table-tops without the use of any tools, which stacks flat into a manageable box that can be either rolled in or shipped on a standard pallet and assembled by one person. The purpose of this product is to provide a stable structure to display a wide range of products that merchandise on slatwall, pegboard, shelves, tables and free-standing pedestals as well as garment poles. This display booth provides a way to emulate a retail shopping experience where physical products are sold on varying display mediums. With simple clean aesthetics, this display booth offers a blank canvas for exhibitors to let their product, branding and color themes do the selling. The walls and display features are comprised of flat panel materials such as wood, plastic and/or composite materials that that piece together to create a stable structure. The parts fit to together by inserting hooked tabs into slots that fit the width of the tabs. Since all the parts are interchangeable, the system allows for multiple configurations, as well as easy expansion of the display booth by adding more parts. Additionally, since the panels are all flat, they stack on top of each other for easy storage, set up and dismantle.

BACKGROUND

Trade shows are a common means for vendors to advertise their goods and services to the trade. These shows are held worldwide and attract vendors, buyers, and resellers from ail over the world. Large sums of money are spent by vendors to display their products in an interesting and eye catching manner. Generally, the vendor either purchases or makes a display booth and ships it to the trade show where it is assembled. After the show, the display booth is disassembled and shipped back to the vendor's place of business or an outside contractor where it is stored until the next trade show. It is not uncommon for a vendor to attend multiple trade shows annually.

The display booths commonly available are not only expensive to purchase or rent, but they also are extremely costly to construct, ship, assemble, disassemble, and store. The extreme ongoing expense associated with these standard display booths is due to the requirement of hiring labor to assemble the weight and large size. Standard display booths are often constructed of heavy, large format materials (such as sheets of plastic, MDF, acrylic and metal), in addition to heavy frame structures, and require screws, staples, pins, and metal rods to assemble, which requires hired union labor that is extremely expensive. While some display booths may be condensed for shipment, they generally must be shipped on multiple large pallets. There are other no tool assembly displays, but most require a large number of unique parts with multiple connectors which takes a considerable amount of time and detail to assemble. Simplicity and easy of assembly is an important part of trade show booths since most people setting up at a show is the salesperson and this is not their main job function.

Advantages of Invention

Although others have invented knock-down, flat pack or tab-and-slot construction products, this invention is superior because it:

May be comprised of relatively small panels which equates to lighter weight, thereby reducing shipping and drayage costs associated with standard display booths;

May be comprised of panels small enough so that they can ship within the confines of a pallet size (44"×48"), thereby reducing shipping and drayage costs associated with standard display booths;

May be comprised in such a way that the pieces all lay flat on top of each other for easy storage and transport, thereby reducing shipping and drayage costs associated with standard display booths;

May be comprised in such a way that the display booth requires no tools or screws to assemble, thereby eliminating the need for union labor and providing a substantial savings;

May be comprised in such a way that the display booth fits in a box that can also function as a table or podium within the booth, for both functionality and easy access during and after the show allowing for the client to not have to wait for a crate and in turns saves time on the road;

May provide a stable structure to support the display of physical product unlike other pop-up booths that only provide a printed fabric wall;

May be comprised in such a way that offers several merchandizing options for displaying product within the booth such as slatwall, peg board, shelves, Audio Visual mounting, garment poles and any other merchandising option typically used in retail environments;

May be comprised in such a way that offers several branding options, such as different graphic panels that may consist of plastic, metal, carbon fiber, wood and other materials that come in different colors and patterns;

May be comprised in such a way that allows for flat paneled components to fit on to the structural tabs or faces for the purpose of concealing the inner workings of the structure and added branding; and May be comprised in such a way that is modular so that the configuration of the display booth is modifiable and can be easily expanded or contracted for each event in any direction; and May be comprised in such a way that the pin holes in the column panels allow for a long block with dowels to fasten to the columns creating a sufficiently deep and wide channel for the purposes of sliding slatwall panels into place. This will allow to columns to support a wall of slatwall panels by having channels on both sides of the inner columns running from the bottom to the top of the structure. Once the slatwall panels are in place a joist will be inserted into the middle of the two columns locking the columns into place and preventing the columns from separating and allowing the slatwall to function with structure stability.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to the similar parts, and in which.

DETAILED DESCRIPTION OF THE INVENTION

The present invention is a system for erecting modular, weight-bearing walls, shelves, slatwalls and garment poles, and table-tops without the use of any tools, which stacks flat into a manageable box that can be rolled into a convention and assembled by one person. The purpose of creating this system is to reduce the cost associated with hiring over-priced convention staff, reducing the weight and size of transporting crate which drastically reduces the cost of the material handling at convention centers as well as the reduction in freight charges on shipping trucks by staying within the size of a 44×48" pallet. The crate serves as the podium by providing finished panels to sit on top of the crate as well as a graphic fabric wrap to conceal the crate and convert into a podium. The crate converting into a podium allows for the client to no longer wait for a shipping pallet or crate at the end of the show saving time and money.

Figure 1:
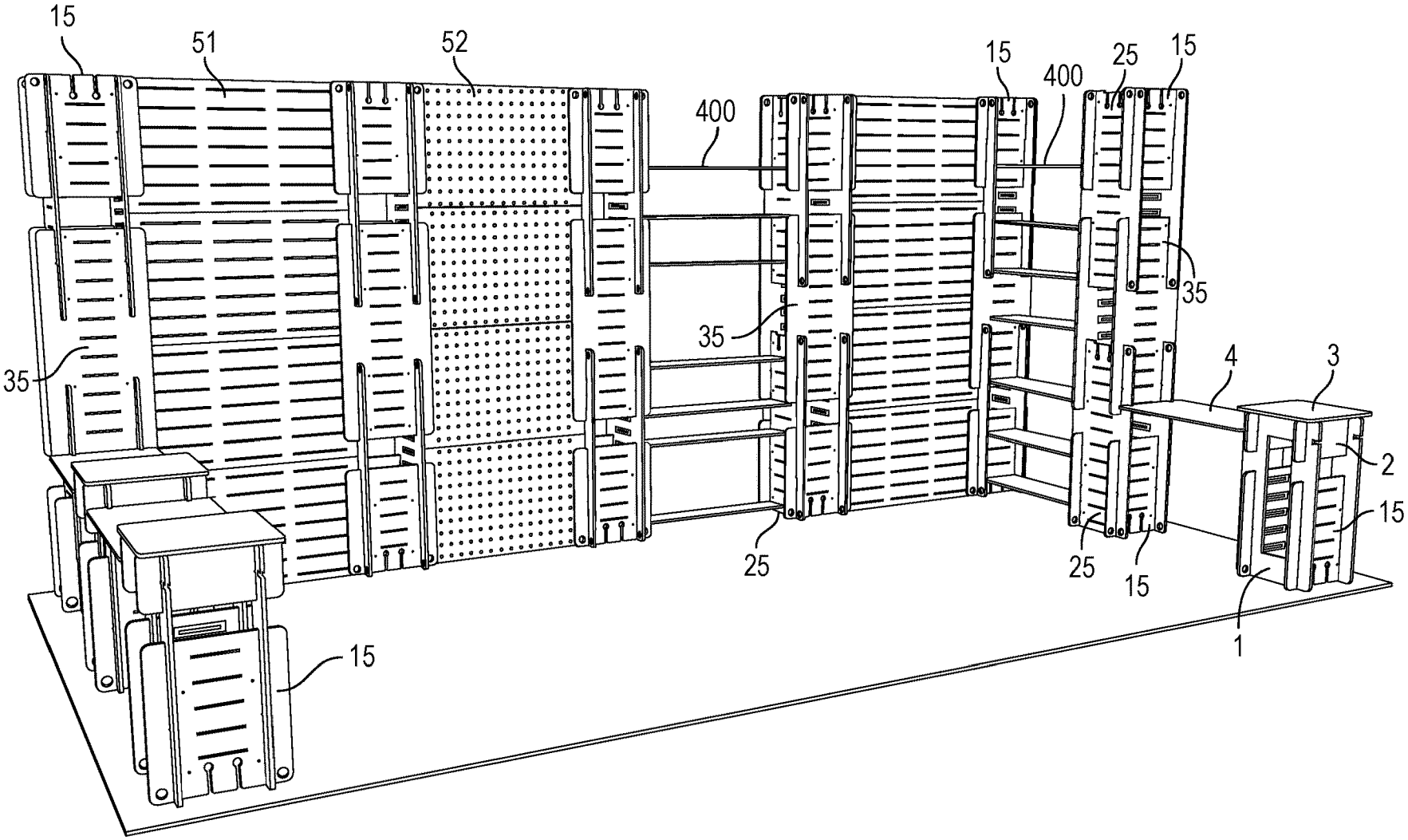
FIG. 1 illustrates a perspective ¾ front view of one configuration of the display booth.

With the above in mind, attention is now directed to FIG. 1, which reveals that the display booth's structure is composed of interlocking flat panels that collectively, when pieced together, provide a stable structure for displaying product and/or sales materials. When the structure is erected after fitting the tabs into opposing slots, the multiple columns provide a stable structure to create a back wall by connecting shelves 62, garment poles, slatwall 51 and peg board 52 panels or a connecting joist 60. The shorter columns provide a stable tabletop surface which can be connected to additional table tops with a table top connecting panel 4 or to taller columns by slotting into cutouts in the edges of the opposing panels on parts 26 and 27. The column structure assembles with parts 14, 26, 27 and 34. The table top assemble using parts 14, 1, 2 and 3. Additional, images of instructions will be provided further into the patent application. In addition, printed fabrics and/or panels can be added to the walls and/or columns and tabletops and the spans between both. The graphic panels and fabric will be discussed in additional drawings. The graphics serve as branding as well as a way to create light weight rooms for larger structures. The graphics provide a clean flat panel on the front for branding and can easily be adhered to the edge of the panels or face of the panels with 2-sided Velcro strips or any other adhesive. The back wall serves as a great branding opportunity in addition to its ability to bear the weight of, among other things, shelving, hooks, garment rods, and mounted flat panel monitors. A bridge shelf 400 can extend between two bridge units to not only provide additional stability to the unit, but also to allow the user of the invention to display additional items. The bridge shelf is attached via two shelf brackets (not shown in this figure but better illustrated in FIGS. 19 and 20.

Figure 2:
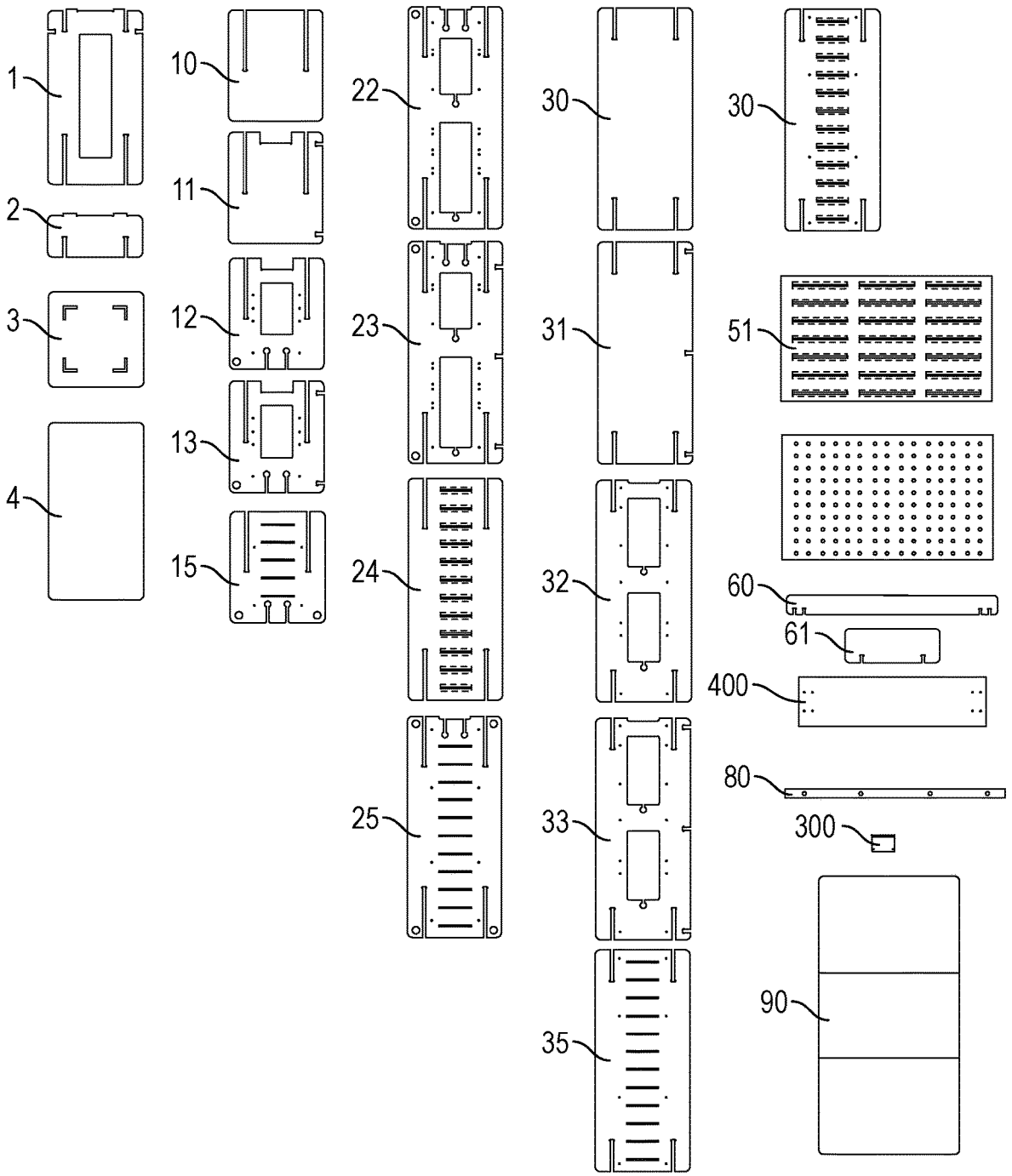
FIG. 2 is a dimensional, vector art view of all the booth parts.
Figure 3:
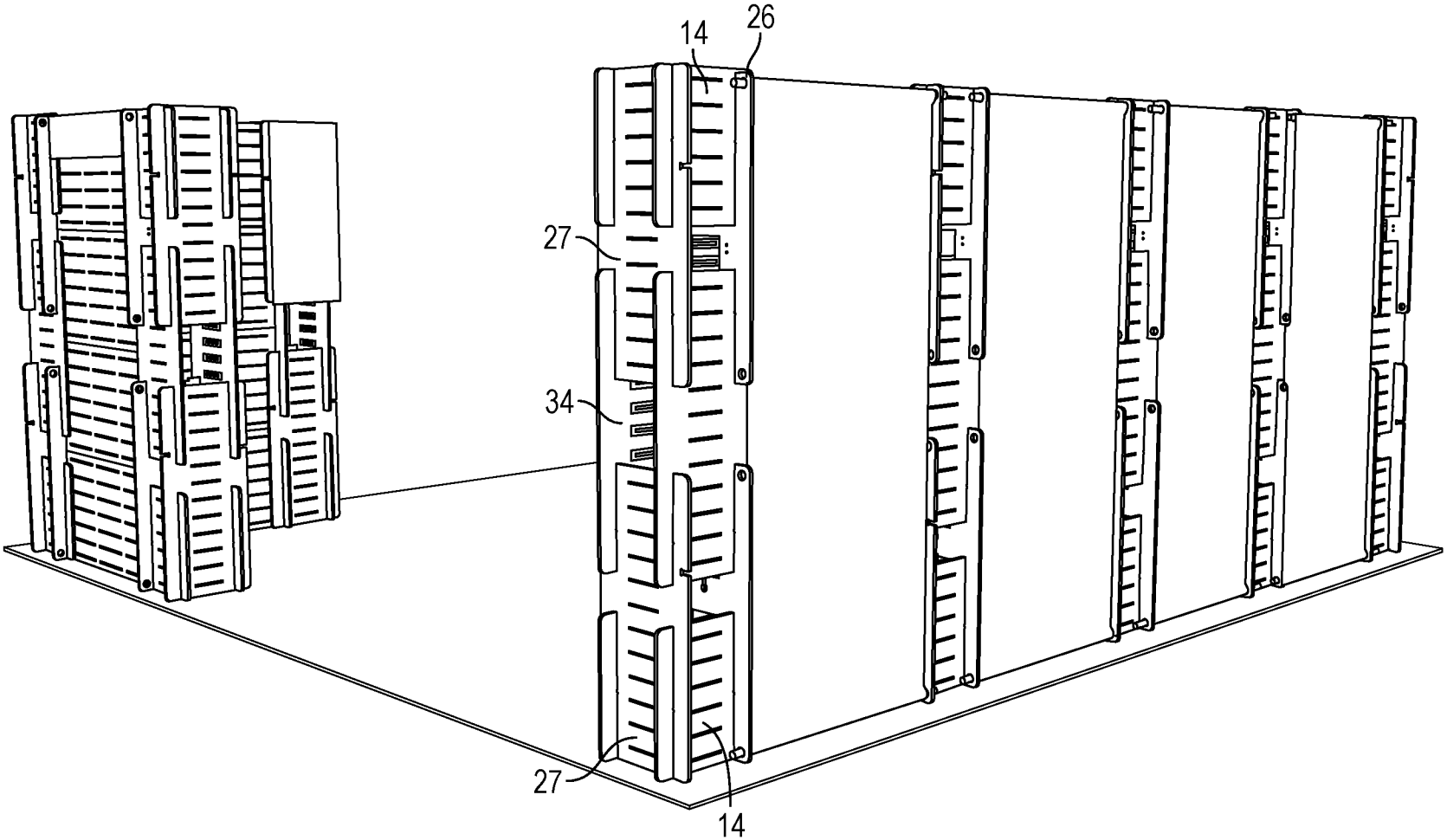
FIG. 3 is a ¾ view of one configuration.

As shown in FIG. 2, this is a 2-dimensional vector art of all the booth parts 1, 2, 3, 4, 10, 11, 12, 13, 14, 15, 22, 23, 24, 25, 26, 30, 31, 32, 33, 34, 35, slatwall 51, peg board 52, joist 60, column shelf 61, shelf 62, slatwall block 80, crate top 90;

As shown in FIG. 3, the display booth essentially does not have a back or front and is aesthetically pleasing from all angles as show in this island open configuration which is a typical set up for a larger trade show booth space. This is a critical point of differentiation between most trade show booths in the market and provides a more diverse benefit of display capabilities. An example is that all columns can be configured with slatwall on all sides for aesthetics or merchandising using parts 14, 34 and 27. Graphic banners can be used for branding on the outside of the structure.

Figure 4:
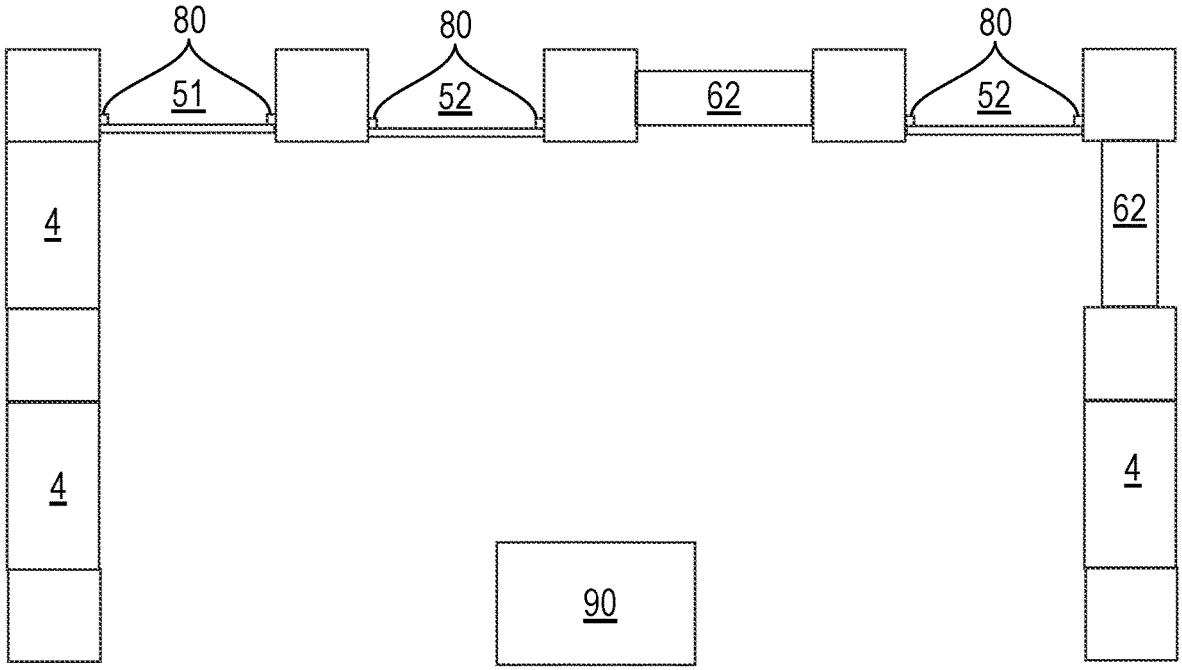
FIG. 4 is an aerial view of another configuration.

As shown in FIG. 4, this is an aerial view showing multiple tabletop features for displaying product connected by table top connectors 4 as well as locations for shelves 62, slatwall 51 and pegboard 52 from the walls of the display booth. The slatwall 51 and pegboard 52 are assembled by installing part 80 into part 26 of the columns to create a channel to receive the panels. Additionally, the crate that houses the display booth can be used as display structures using part 90, as seen in the middle of the display booth. Panel and Fabric graphics are easily adhered or fastened by suing dowels into the round cutouts in the back of parts 26 and 27.

Figure 5:
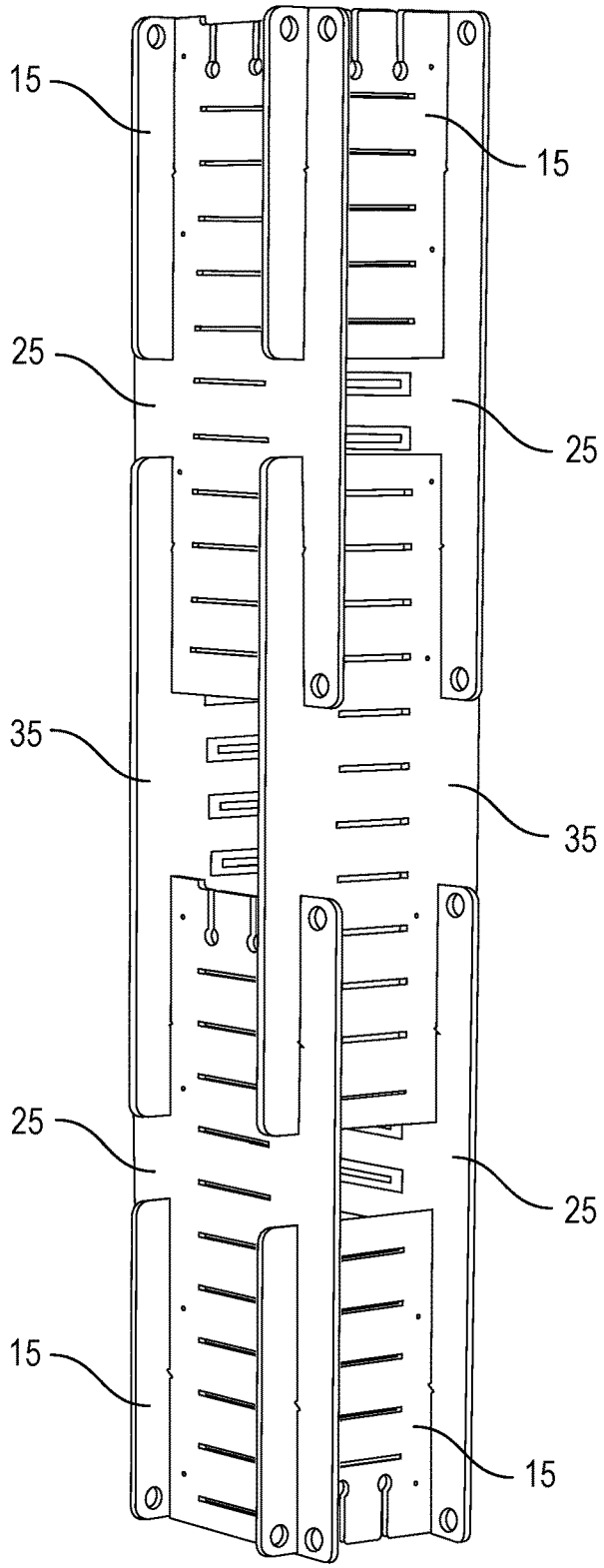
FIG. 5 illustrates a perspective ¾ side view of an assembled as well as an exploded view of one version of a column.
Figure 6:
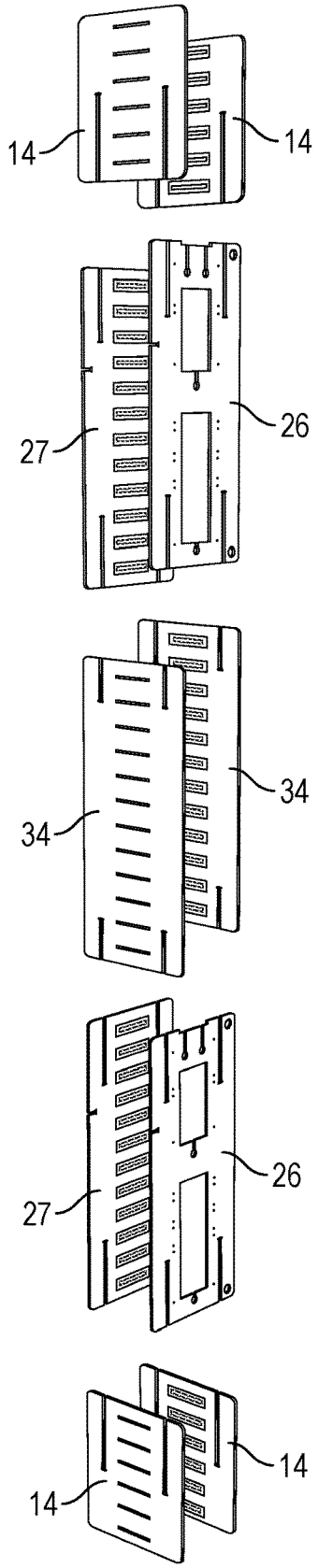
FIG. 6 illustrates a perspective ¾ side view of 2 assembled columns and the slatwall blocks to create a channel for the slatwall panels.

As shown in FIGS. 5 & 6, this is a perspective ¾ side view of an assembled as well as an exploded view of one version of a column. In this embodiment the entire column is comprised of 4 unique pieces. The bottom of the column is comprised of two parts 14 which provide part of the base structure as well as slatwall merchandising for the front and back of the column. When parts 27 and 26 slot into the opposing slots of parts 14 they create a square base structure for the rest of the column parts. Part 27 provides slatwall merchandising for the end of the display column. Part 26 has cutouts to accommodate dowels for the purposes of stretch graphic banners between the columns from top to bottom. The taller rectangular cutouts provide a space for shelves to rest on when 2 columns are erected and the opposing column is aligned with the other. Additionally, there are shelf pin holes to receive after-market shelf pins to allow for the shelves to adjust up and down and sit on 4 shelf pins. Additionally, part 26 and 27 both has a horizontal cutout to receive small shelves as well as a panel 4 to connect the columns to smaller table tops comprised of parts 10, 1, 2 and 3. Additionally, part 26 has vertical cutouts that allow for a joist to be dropped into when 2 columns are erected and the opposing side is in alignment. The joist 60 is intended for securing the 2 columns in place as well as providing a place for a graphic panel to rest in on top of the columns for additional branding. Next parts 34 slot into the top of parts 26 and 27 to create the forward facing and backward facing slatwall columns. The next parts to build the column are part 26 and 27 again which provide the additional utility functions described in the lower part of the column. Finally, two parts 14 are flipped upside down to slot into the top of parts 26 and 27 to complete an 8' tall column which conforms to typical trade show convention guidelines.

Figure 7:
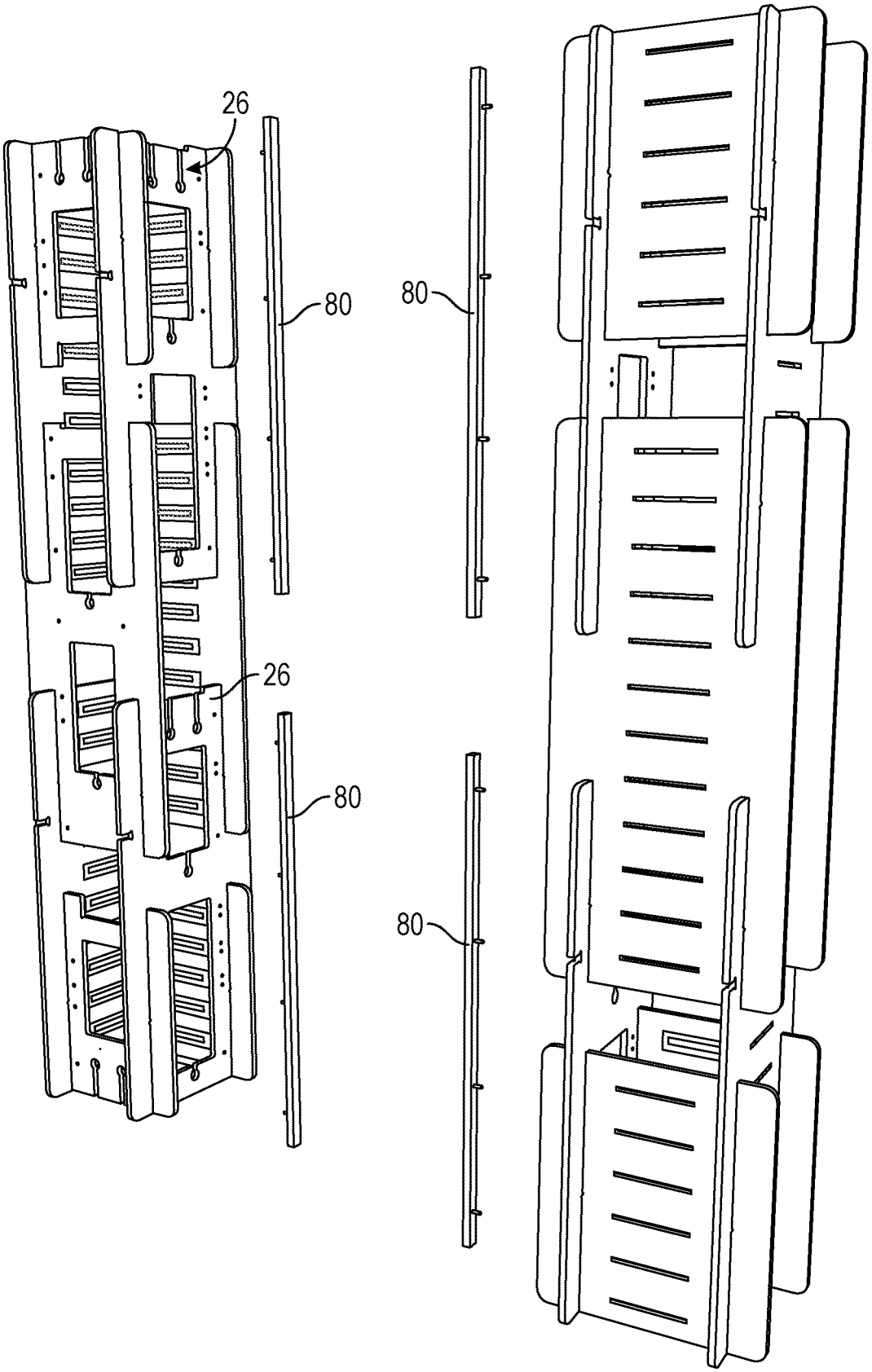
FIG. 7 illustrates a perspective ¾ side view of 2 assembled columns and the 4 slatwall panels stacked on top of each other with a joist to secure the columns together.
Figure 8:
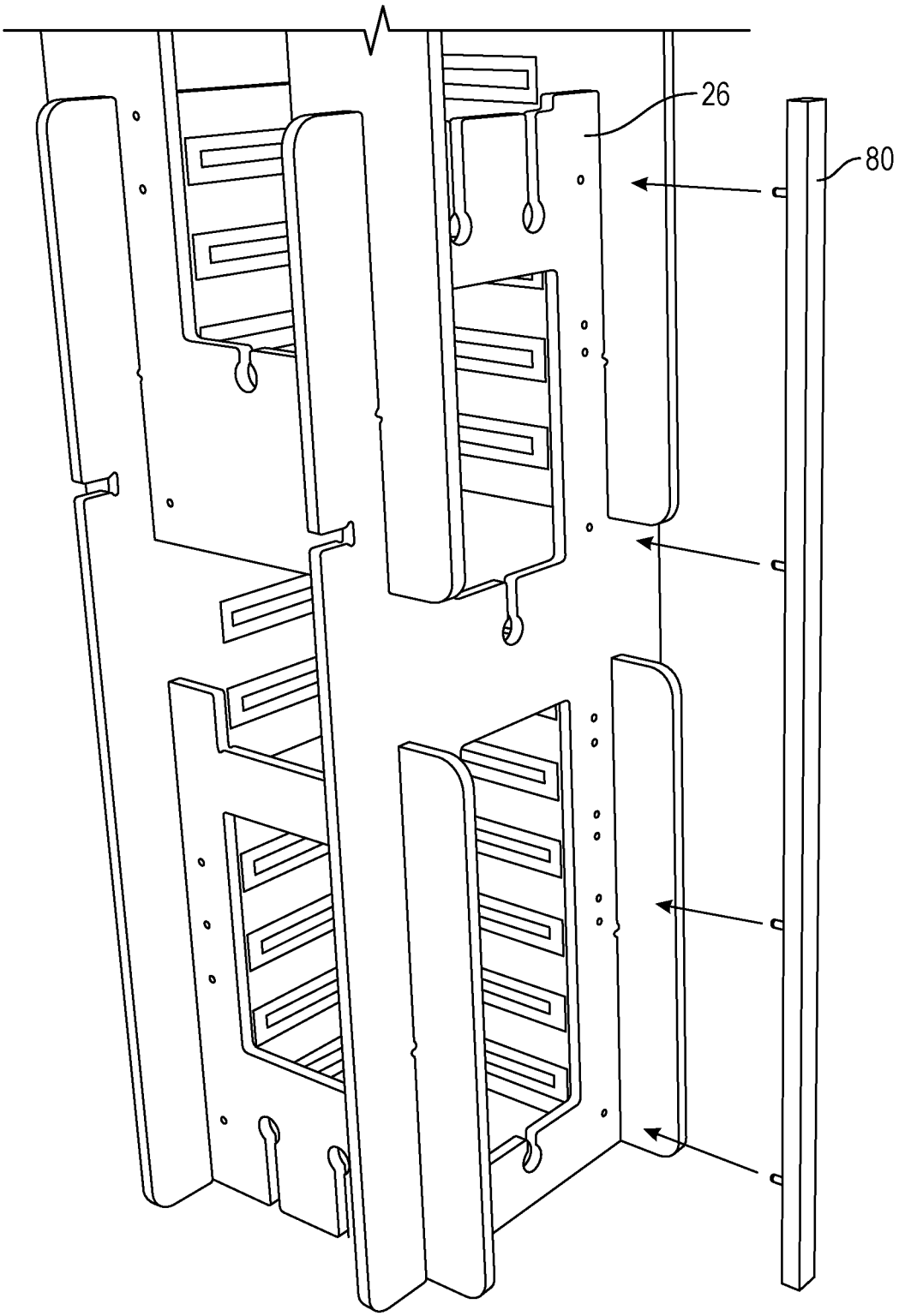
FIG. 8 illustrates a perspective ¾ side view of 2 assembled columns, with 2 sets of 4 slatwall panels stacked on top of each other all secured together with the joist in the middle of the 2 columns for the purposes of merchandising on the front and back of the wall.

As shown in FIG. 7-8, this is 2 perspective ¾ side views of a detail view of one column and 2 assembled columns and the slatwall blocks 80 to create a channel for the slatwall panels 51. Once the blocks are inserted into the shelf pins located on the faces of parts 26 they create a depth and width that creates a channel for a slatwall panel 51 to slide into. There are 2 blocks on each inside column that create an 8' tall channel, four slatwall panels 51 stack on top of each other while nested into the channel of one column. Once they are stacked the other column slides toward the opposing column and the slatwall 51 nests into the opposing channel. Align the columns and insert all 4 slatwall blocks 80 into parts 26 in the column. Each Block has 4 wood pegs that match up with the shelf pin holes between the columns in part 26. Install the blocks first before inserting the slatwall 51 into the channel.

Figure 9:
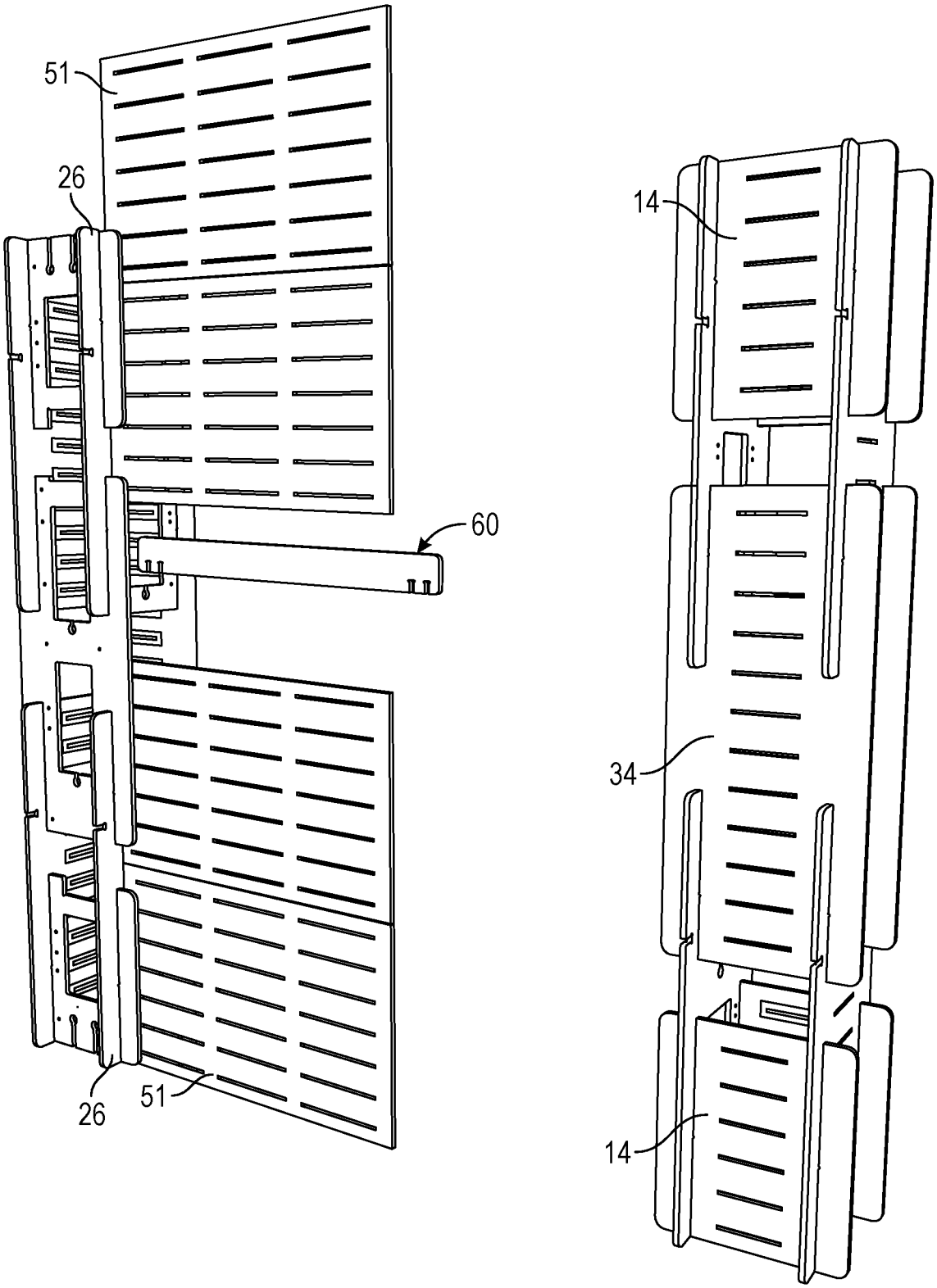
FIG. 9 illustrates a perspective rear view of 2 assembled columns with 4 images that describe the installation of the fabric branding walls using dowels to stretch from top to bottom.
Figure 10:
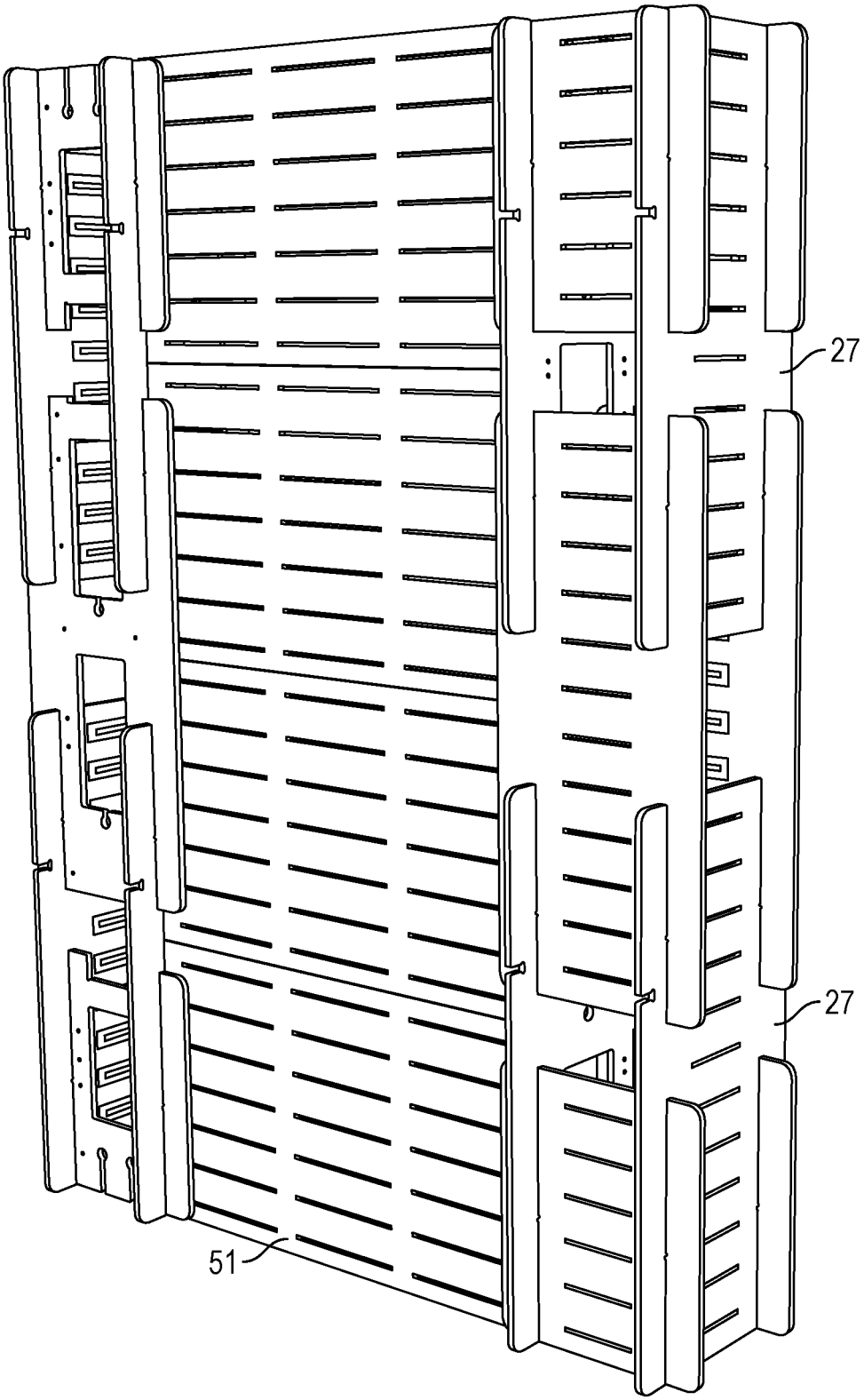
FIG. 10 illustrates 2 perspective aerial front views and 1¾ perspective side view of 2 assembled columns that describe the installation of the graphic panels with 2-sided adhesive Velcro.

As shown in FIG. 9-10, this is two perspective ¾ side view of two assembled columns and four slatwall panels 51 stacked on top of each other with a joist 60 to secure the columns together, Once the columns are pushed together a joist 60 is fastened by inserting the slots of the joist into the perpendicular slot cutouts in parts 26. The joist 60 will prevent the columns from separating and allow for product to be loaded onto the slatwall 51 with the use of aftermarket shelves, hooks and other merchandising solutions for slatwall 51 or peg board 52. After the blocks have been installed, start to slide the slatwall 51 into the channels and on top of one another. Place the joist into the center of the column. Then start to nudge the adjacent column into place and insert the slatwall into the channel. Make sure slatwall slides into the adjacent space between the blocks and column. Lock joist into adjoining column with the vertical cutout un part 26.

Figure 11:
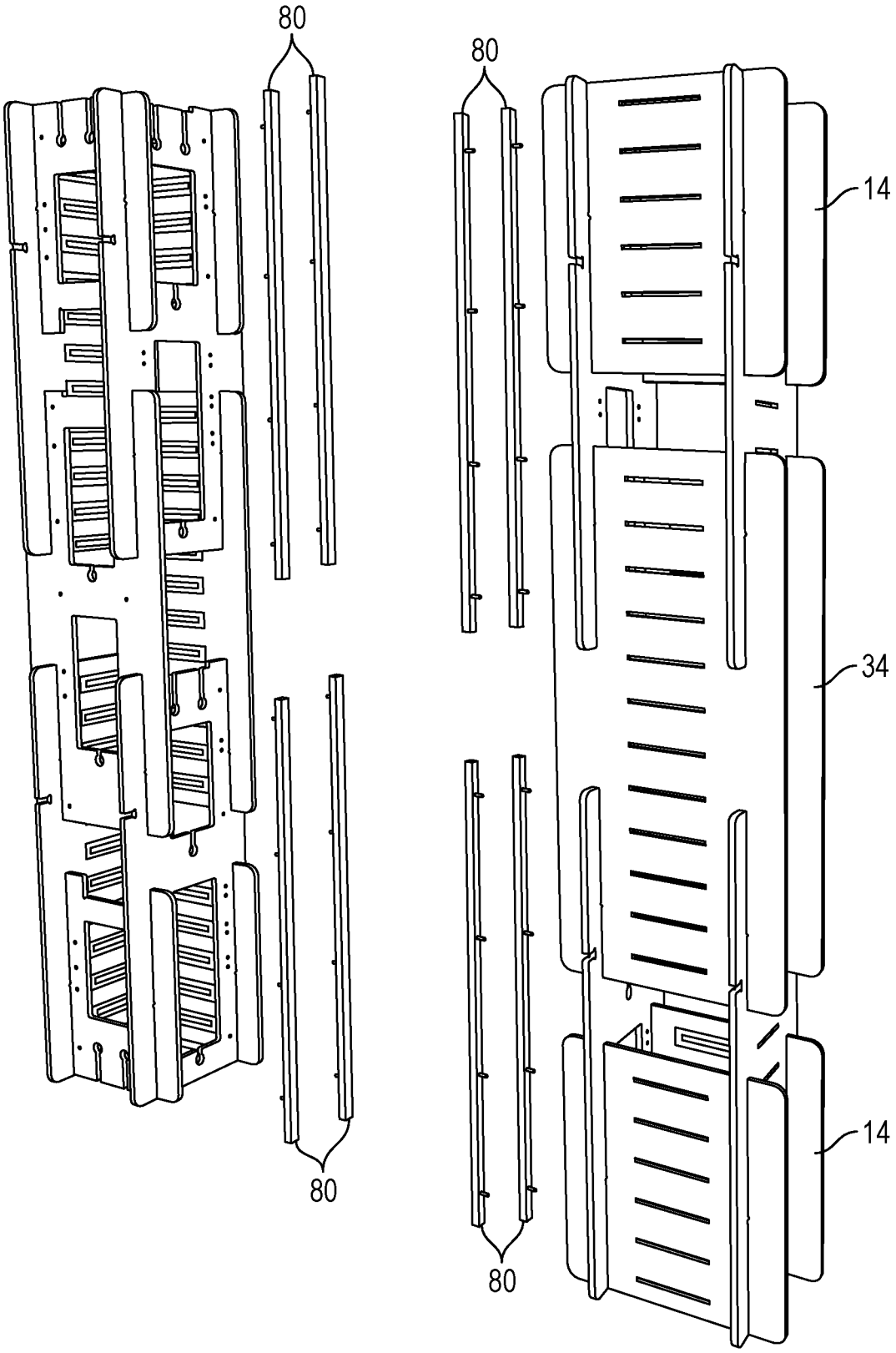
FIG. 11 is a perspective view of various columns.
Figure 12:
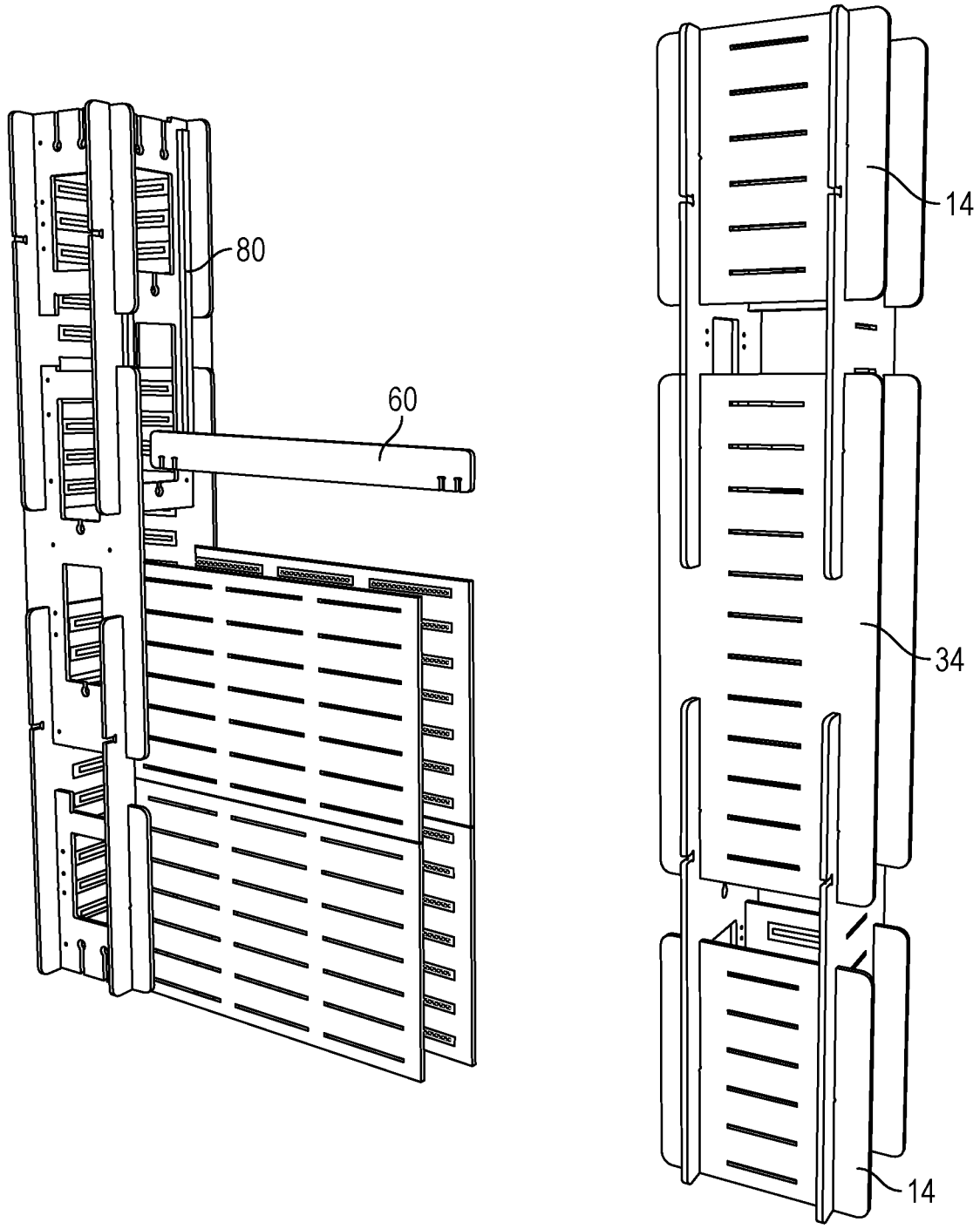
FIG. 12 is a perspective view of a column with slatwall.
Figure 13:
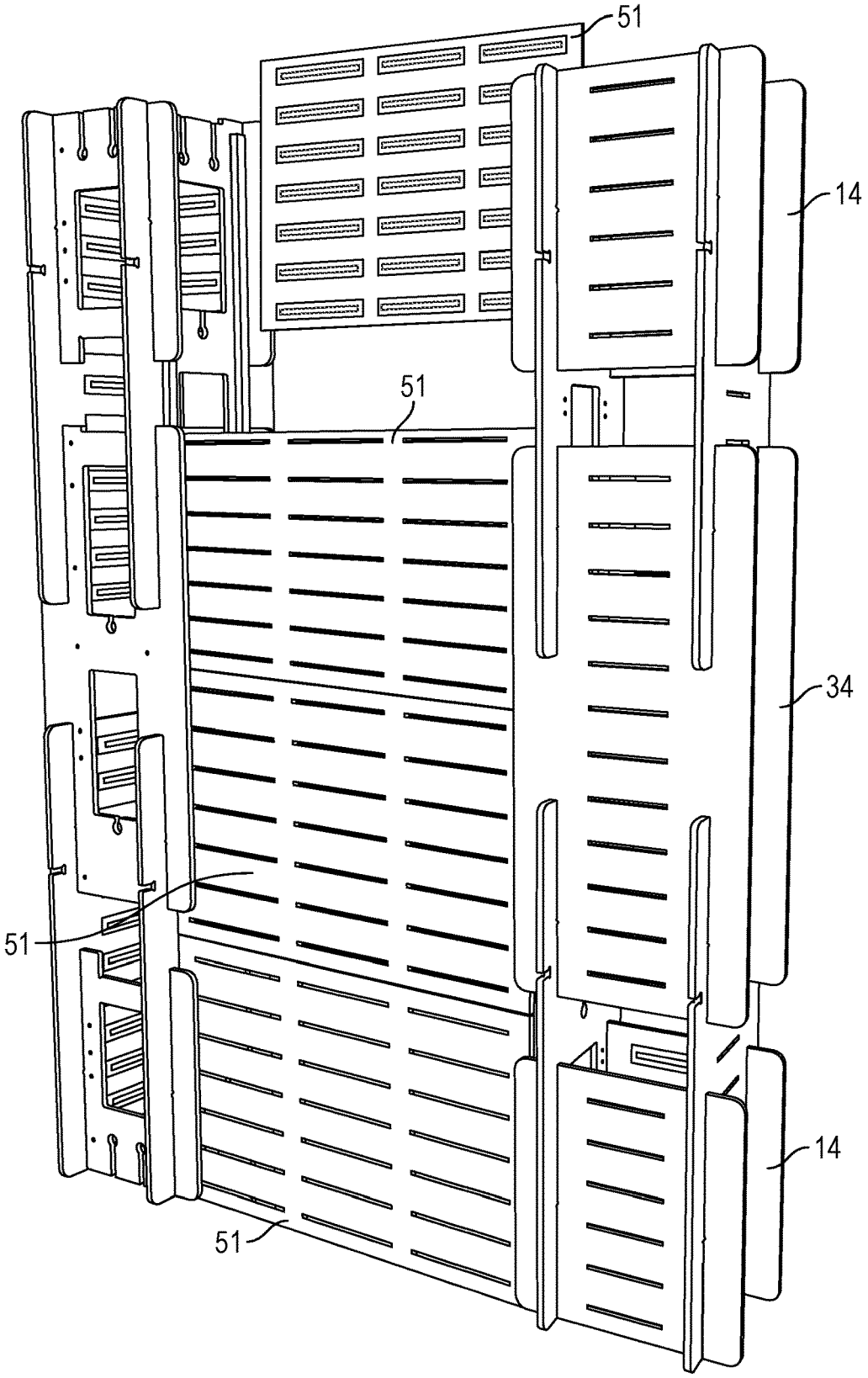
FIG. 13 is a perspective view of two columns with slatwall.

As shown in FIG. 11-13, this is a perspective ¾ side view of 2 assembled columns, with 2 sets of 4 slatwall panels stacked on top of each other and positioned inside a channel created by inserting the slatwall blocks with the pegs that line up with matching holes in part 26. The first step is inserting all 4 slatwall blocks 80 into the matching holes in part 26. After slatwall blocks 80 are installed, slide slatwall 51 into lower channels. Slide the joist 60 into place and nudge the adjacent column into place. Ensure that slatwall slides into the similar channels on the adjacent column and the joist locks down to keep the columns in place. Then all the panels are secured together with the joist 60 in the middle of the 2 columns for the purposes of merchandising on the front and back of the wall. There are 2 sets of shelf pin holes on either side of the length of part 26. The shelf pin holes are on either side for the use of support shelves as well as creating 2 sets of channels to receive slatwall panels 51 once the slatwall blocks 80 are inserted into the holes. When slatwall merchandising is needed on both sides of the wall the slatwall 51 is positioned right behind panels 14 and 34 facing outward and backward for a double wall of slatwall. The second set of 4 slatwall panels 51 need to be dropped in from the top of the column into the 2 channels. Each panels stacks on top of each other until the last one is flush with the top of the column.

Figure 14:
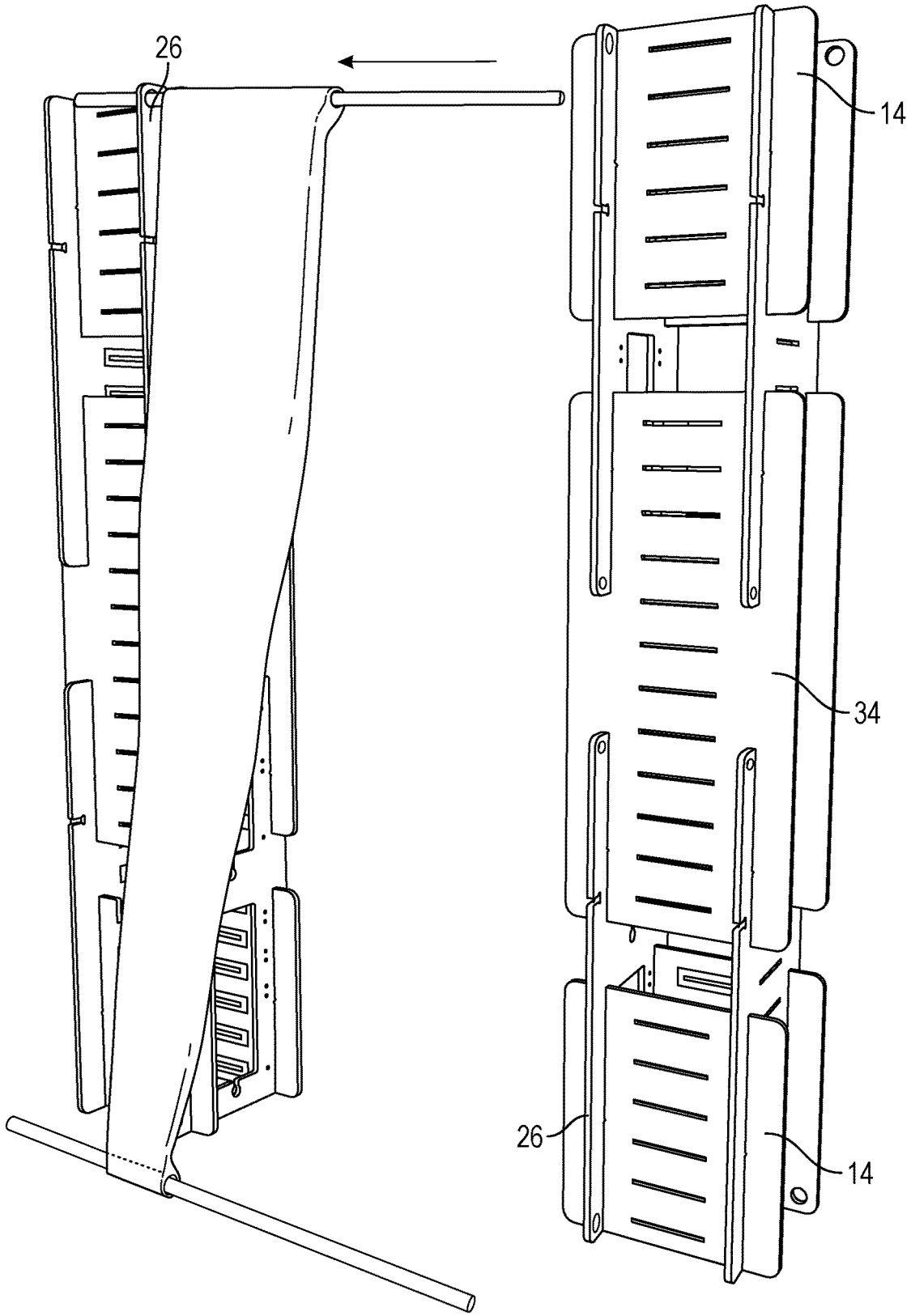
FIG. 14 is a perspective view of a hanging fabric banner.
Figure 15:
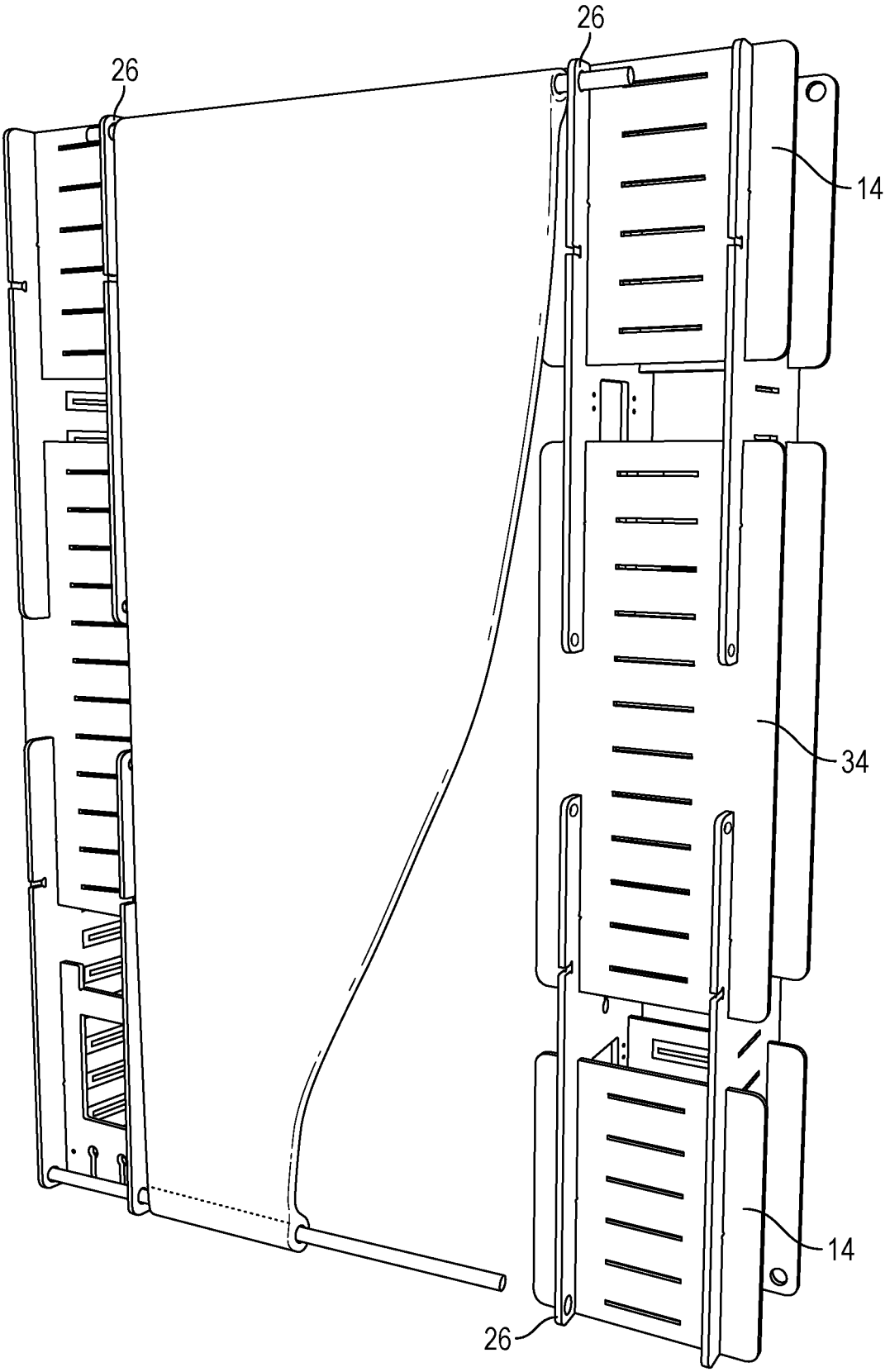
FIG. 15 is a perspective view of a hanging fabric banner.

As shown in FIGS. 14 & 15, this is a perspective rear view of 2 assembled columns with 4 images that describe the installation of the fabric branding walls using dowels to stretch from top to bottom. The dowels slide into the circular cutout in the top and the bottom of parts 26 between the 2 columns. Insert the top dowel into the top dowel opening of Part 26. Slide top dowel into the opposite column opening and center the dowel. Start to spread out the banner at the top. Pull down on the lower dowel to make the banner taut. Insert the lower dowel into the bottom dowel opening of part 26. Insert the lower dowel into the opposite column dowel opening and center. Spread out the lower banner for a clean installation.

Figure 16:
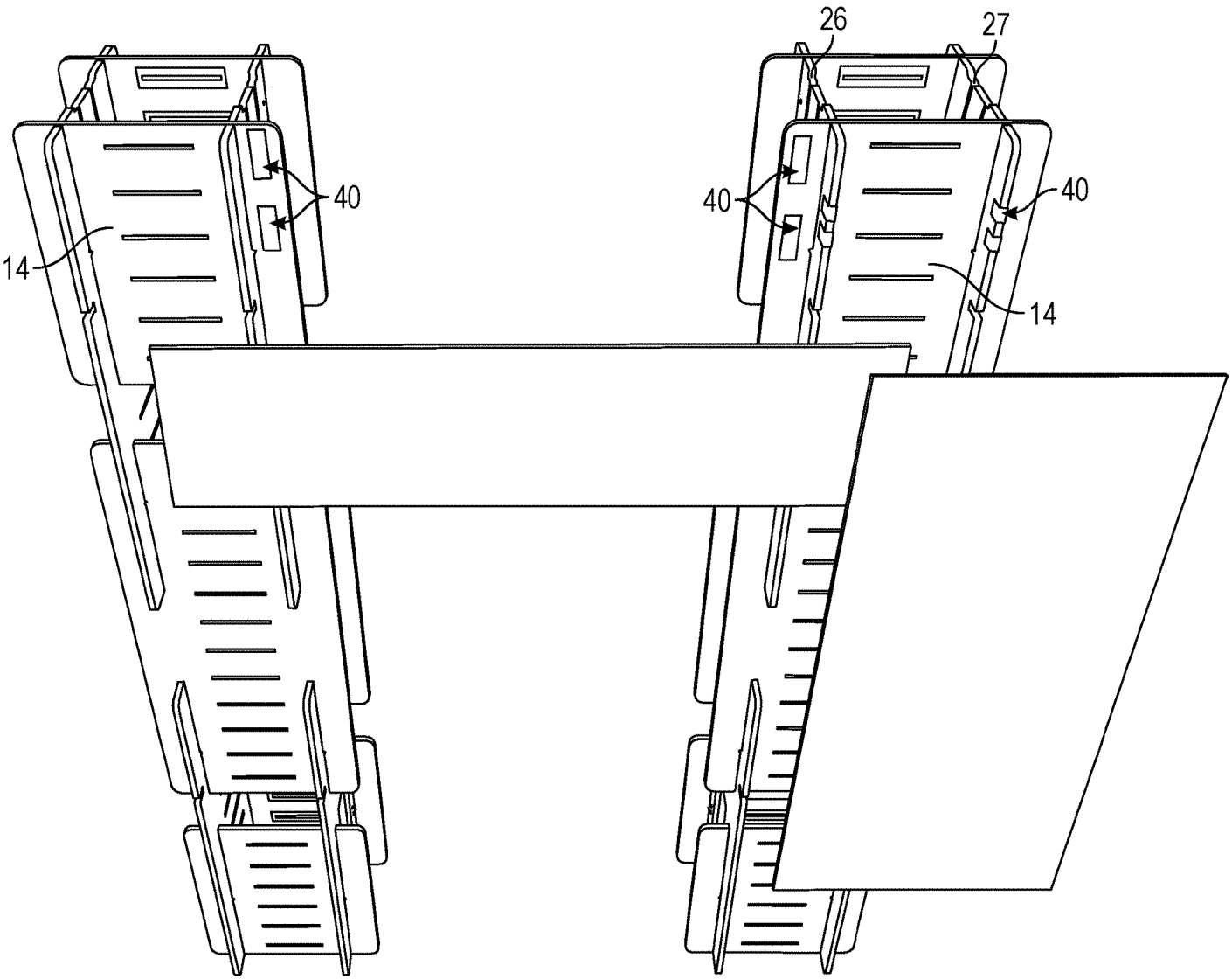
FIG. 16 a perspective aerial front view of 2 assembled columns.
Figure 17:
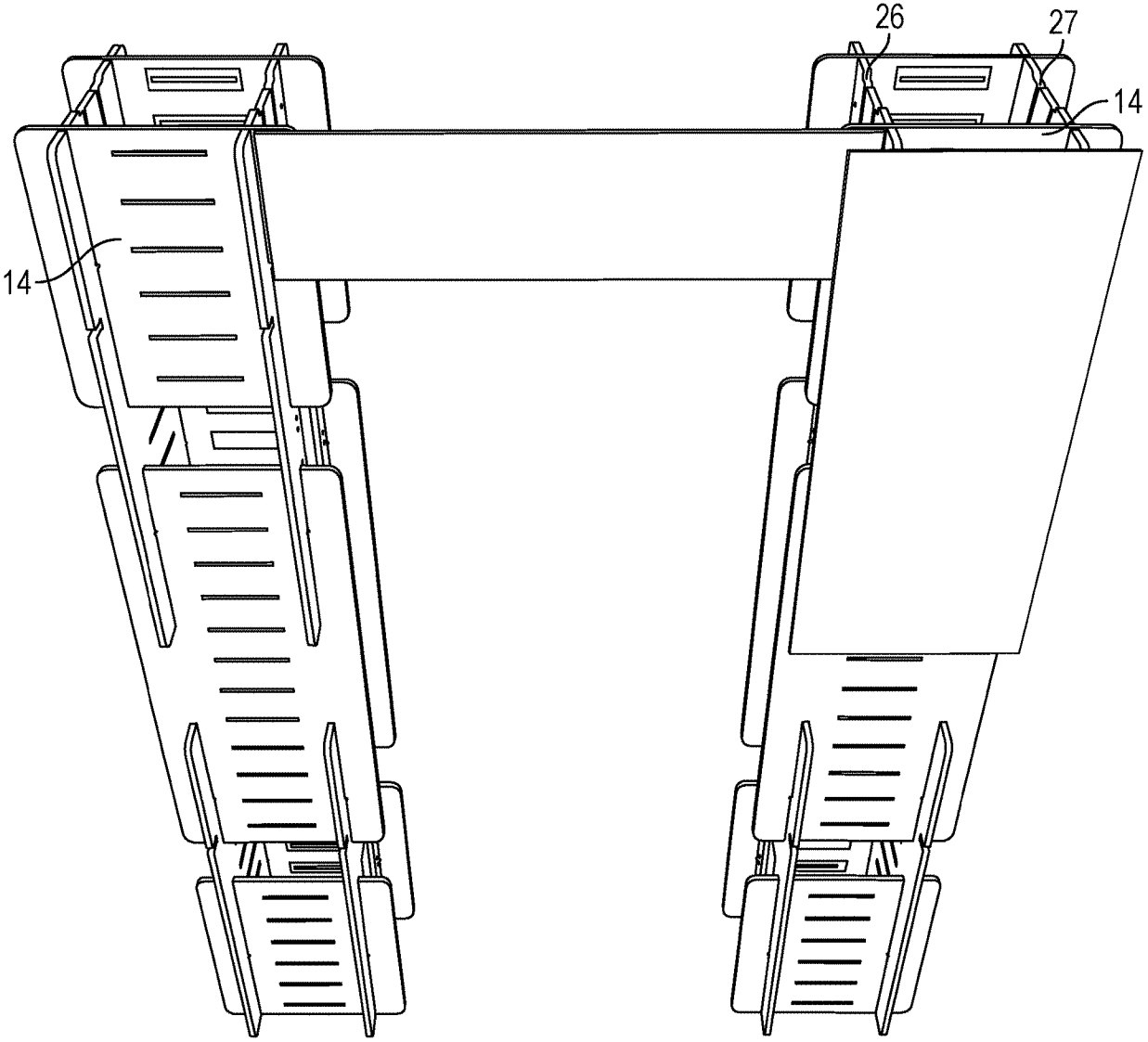
FIG. 17 a perspective aerial front view of 2 assembled columns.

As shown in FIG. 16 and FIG. 17, this is a perspective aerial front view of 2 assembled columns that describe the installation of the graphic panels with 2-sided adhesive Velcro 40. The header panels can adhere to the faces of part 14 and the column graphics can adhere to the edges of part 26 and 27.

Figure 18:
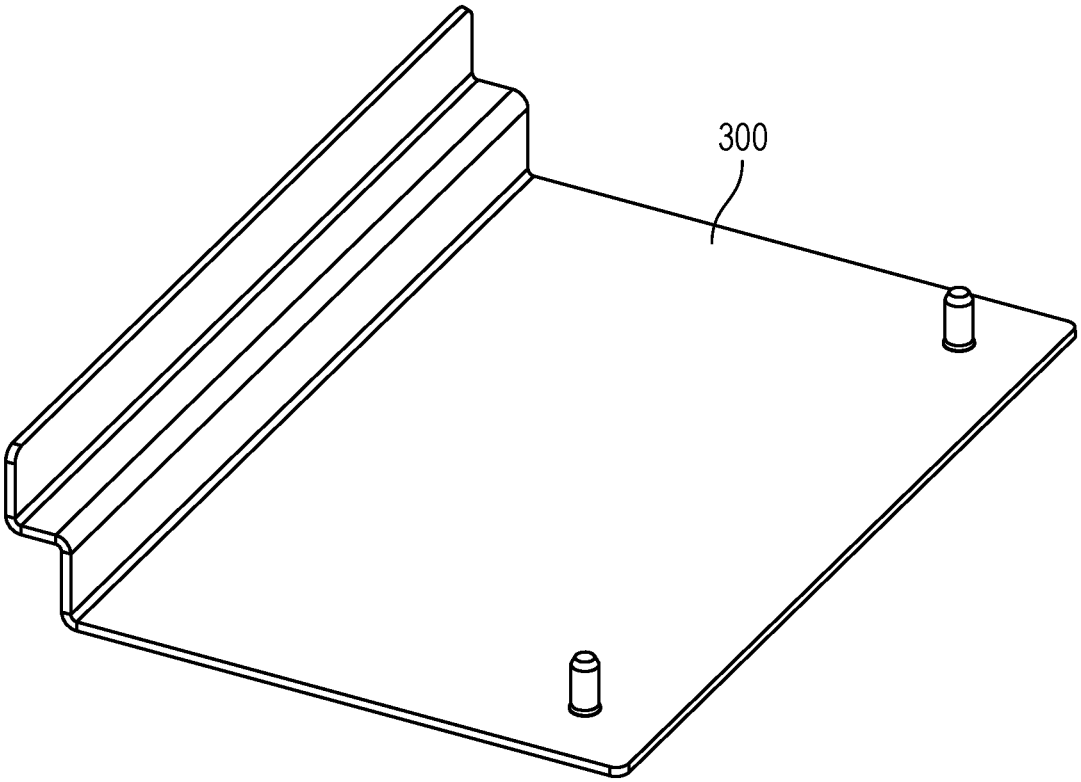
FIG. 18 is a perspective view of the shelf bracket used to attach a bridge shelf to two bridge units.

FIG. 18 is a perspective view of the shelf bracket used to attach a bridge shelf to two bridge units. The shelf bracket has two prongs that mate with two corresponding holes in the underside of the bridge shelf (shown more fully in FIG. 19), and an insert portion that fits into a slot in a bridge unit.

Figure 19:
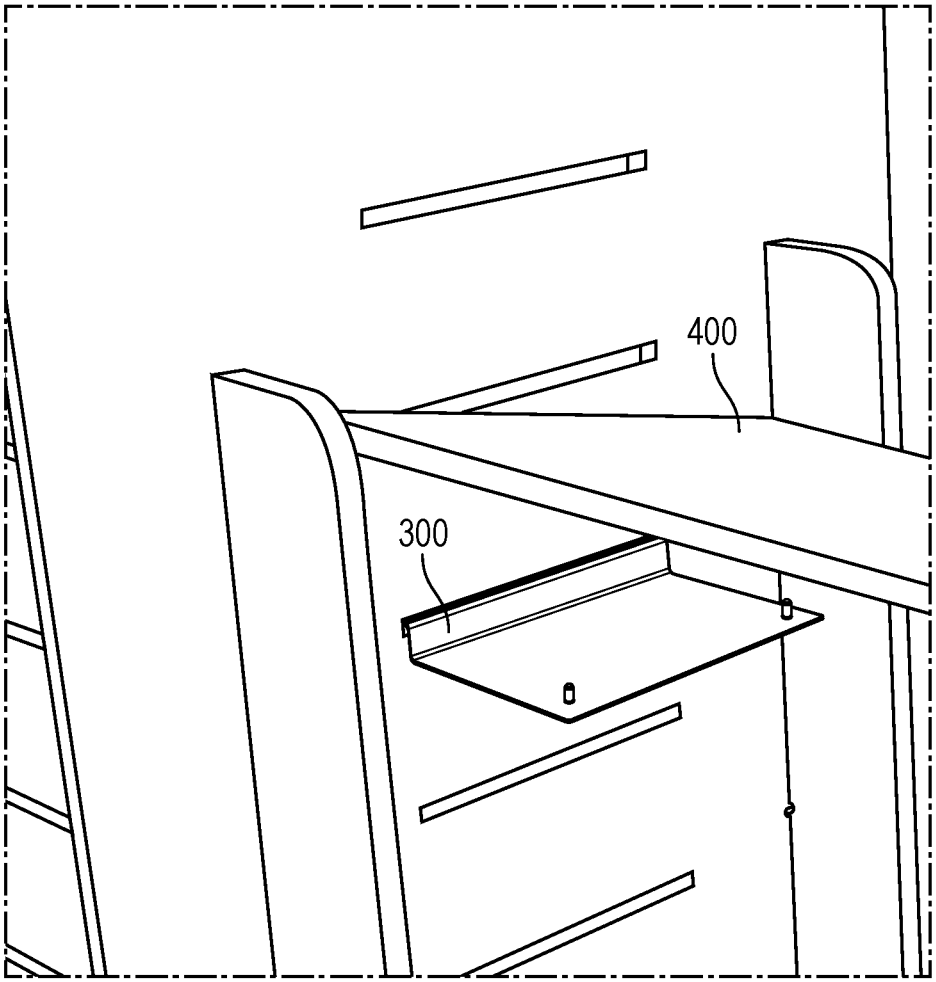
FIG. 19 is a perspective view of the bridge shelf being secured upon a shelf bracket.

FIG. 19 is a perspective view of the bridge shelf 400 being secured upon a shelf bracket 300. The insert portion of the shelf bracket has already been installed into the slot on the bridge unit, and the bridge shelf 400 is being placed on top of the shelf bracket 300. Two prongs on the shelf bracket 300 will mate with two corresponding holes on the underside of the bridge shelf 400 to removably secure it in place.

ADDITIONAL EMBODIMENTS TO THE INVENTION

Another embodiment of the present invention provides for self-interlocking tabs that snap and secure the parts together;

Another embodiment of the present invention provides for shelving and tabletops that can be connected to the walls and frame via the tab and slot system;

Another embodiment of the present invention provides for magnets to be impregnated into the panels to strengthen the connections between the supporting structure and display surfaces like shelving and table tops;

Another embodiment of the present invention provides for garment poles that can be connected to opposing walls via recessed design features to provide a utility for merchandising apparel on hangars;

Another embodiment of the present invention provides for peg holes that can be extruded from the structure's wall parts to provide a utility for packaged products;

Another embodiment of the present invention provides for horizontal L-shaped recesses in the wall parts that can be extruded to provide a utility for inserting shelving that is constructed with complimentary fitting pieces that lock into place and provide a stable surface for merchandising product. This system is sometimes referred to as slatwall; and Another embodiment of the present invention provides aesthetic cover-panels (that come in a variety of materials, colors, and patterns) that secure onto the walls and frame by fitting the tabs onto matching recessed extrusions on the back of the panels to conceal the underlying tab-and-slot structure;

Another embodiment of the present invention provides for the ability to hang printed banners on the outside and inside of the display booth for the purposes of company branding;

Another embodiment of the present invention provides for an upward hook feature at the top of the booth structure that a banner attached to a pole can rest on horizontally as well as downward facing hook features at the base of the of the booth structure that can hook under to ultimately fasten a tall banner in place to the side of the booth structure;

Another embodiment of the present invention provides for removable covers in the structure that will reveal holes for mounting AV supplies such as flat panel monitors as well as room for electrical wires to run through;

One embodiment of the present invention provides for the container that houses the disassembled display booth to have wheels so that the display booth can be rolled by one person; and It will be appreciated that details of the foregoing embodiments, given for purposes of illustration, are not to be construed as limiting the scope of this invention. Although several embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What I claim is:

1. A modular trade show display with interlocking slots, comprising a column, where the column comprises four end units, four bridge units and two middle units, where each end unit has an end unit end and two end unit slots, where each bridge unit has a bridge unit top end and a bridge unit bottom end, and where each bridge unit has four bridge unit slots, with two bridge unit slots at the bridge unit top end and two bridge unit slots at the bridge unit bottom end, and where each middle unit has a middle unit top end and a middle unit bottom end, and where each middle unit has four middle unit slots, with two middle unit slots at the middle unit top end and two middle unit slots at the middle unit bottom end, and where each of the end unit slots removably slot into one of the bridge unit slots, and each of the middle unit slots removably slot into at least one of the bridge unit slots, where there is at least one bridge shelf connecting at least two bridge units, where the at least one bridge shelf is connected to the at least two bridge units by two brackets, where the at least one bridge shelf has two end sections, and where each of the two sections has two holes in an underside portion, and where each bracket has two prongs that mate with the two holes in the underside portion, and where each bracket has an insert portion that mates with a bridge unit slot, where two end units are aligned parallel in a first direction to each other to form a base, and two end units are aligned parallel in the first direction to each other to form a top, and the two middle units are aligned parallel in the first direction for form a middle, and two of the bridge unit are aligned in a second direction to form a lower support, and two of the bridge units are aligned in the second direction to form an upper support, and where the first direction is perpendicular to the second direction, and where the column comprises, in a sequence, from a column bottom to a column top, two end units, two bridge units, two middle units, two bridge units, and two end units, such that all of the end units are parallel to the two middle units, and all four of the bridge units are parallel to the other bridge units, additionally comprising a second column and a backwall, where the backwall is connected to the first column and to the second column, such that there are two columns, where the second column is an identical to the first column, where the second column also comprises four end units, four bridge units and two middle units.

2. The display of claim 1, where the first column and the second column each contains at least one slat wall cutout, where the at least one slat wall cutout can removably retain a slat wall insert to allow for merchandising of one or more items on a surface of both of the two columns, and where the number of bridge shelves is three.

3. The display of claim 1, where the backwall comprises at least one of one or more bridge shelves, one or more garment poles, one or more slat walls, one or more peg boards, and one or more bridge joists.

4. The display of claim 3, where the backwall comprises one or more slat walls, and the slat wall is removably secured to both the first column and the second column by a bridge joist, where the bridge joist interlocks with mating joist slots in both the first column and the second column, such that the first column and the second column are maintained at a desired distance from each other.

5. The display of claim 4, additionally comprising at least two slat wall blocks, where each bridge unit additionally comprises two or more bridge unit peg holes, and where each of the slat wall blocks additionally comprises two or more slat wall block pegs, where each of the two or more slat wall block pegs removably mates with one of the two or more bridge unit peg holes of the bridge unit, creating a slat wall end channel in each column that is bordered on three sides by one of the slat wall blocks, a face side of one of the bridge units and one of the four end units, and a side of one of the middle units, such that the slat wall is removably retained in a slat wall end cavity in both columns.

6. The display of claim 5, where each of the two or more slat wall block pegs additionally removably mates with at least one of the four end units and at least one of the two middle units.

7. The display of claim 3, additionally comprising at least two pegboard blocks, where each middle unit additionally comprises two or more middle peg holes, and where each of the pegboard blocks additionally comprises two or more pegboard block pegs, where each of the two or more pegboard block pegs removably mates with one of the two or more middle peg holes of the middle unit, creating a pegboard end cavity in each column that is bordered on three sides by one of the pegboard blocks, a face side of one of the middle units and one of the four end units, and a side of one of the bridge units, such that the pegboard is removably retained in a pegboard end cavity in both columns.

8. The display of claim 3, additionally comprising a third column, where the third column is an identical to the first column, where the third column also comprises four end units, four bridge units and two middle units, where at least one of the first column and the second column, and the second column and the third column, are removably connected by one or more bridge joists, and where at least one column additionally comprises the backwall, where the backwall comprises one or more slat walls, and the slat wall is removably secured to both the first column and the second column by a bridge joist, where the bridge joist interlocks with mating joist slots in both the first column and the second column, such that the first column and the second column are maintained at a desired distance from each other, and additionally comprising at least two slat wall blocks, where each bridge unit additionally comprises two or more bridge unit peg holes, and where each of the slat wall blocks additionally comprises two or more slat wall block pegs, where each of the two or more slat wall block pegs removably mates with one of the two or more bridge unit peg holes of the bridge unit, creating a slat wall end cavity in each column that is bordered on three sides by one of the slat wall blocks, a face side of one of the middle units and one of the four end units, and a side of one of the bridge units, such that the slat wall is removably retained in the slat wall end cavity in both columns.

9. The display of claim 8, where each of the two or more slat wall block pegs additionally removably mates with at least one of the four end units and at least one of the two middle units of the first column, and with at least one of the four end units and at least one of the two middle units of the second column.

10. The display of claim 9, where each of the two or more slat wall block pegs additionally removably mates with at least one of the four end units and at least one of the two middle units of the first column, and with at least one of the four end units and at least one of the two middle units of the second column, and at least one of the four end units and at least one of the two middle units of the third column.

11. The display of claim 8, where the first column, the second column, and the third column are in alignment.

12. The display of claim 8, where the first column and the second column make a first panel, and the second column and the third column make a second panel, and where the first panel is perpendicular to the second panel.

13. The display of claim 8, where, for each of the first column and the second column, each end unit has an end side, where the end side does not contact any other part of the display, and each end unit has a connection side where the connection side removably mates with the two bridge units, where each connection side of each end unit has two end unit slots, where each bridge unit has four bridge unit slots, including two upper bridge unit slots and two lower bridge unit slots, where a base end unit has two base unit bridge end slots which removably mate at a 90 degree angle with two bridge unit slots, where each middle unit has four middle unit connection slots, with a first two middle unit connection slots on a first middle unit end and a second two middle unit connection slots on a second middle unit end, and where the first two middle unit connection slots removably mate with a first two bridge unit slots of a first bridge until at a first 90 degree angle, and where the second two middle unit connection slots mate with the second two bridge unit slots of a second bridge unit at a second 90 degree angle.

14. The display of claim 13, where the display comprises a base section, where the base is comprised of two end units, a lower support, where the lower support is removably secured to the base, a middle, where the middle is removably connected to, and located above, a lower connection section, and where the middle is removably connected to, and located below, and an upper connection section, and where a top end unit is located above, and removably connected to, the upper connection section, where at least the lower support, the middle, and an upper support have at least one slat wall cutout, where the at least one slat wall cutout can removably retain the slat wall insert to allow for merchandising of one or more items on a surface of the columns.

15. The display of claim 14, where no part of the display is wider than 48" and not part of the display is longer than 48", such that all the parts of the display will fit on a 44"×48" pallet.

16. The display of claim 14, where each middle unit has four middle unit connection slots, with a first two middle unit connection slots on a first middle unit end and a second two middle unit connection slots on a second middle unit end, and where the first two middle unit connection slots removably mate with a first two bridge unit slots of a first bridge until at a first 90 degree angle, and where the second two middle unit connection slots mate with the second two bridge unit slots of a second bridge unit at a second 90 degree angle, where the display comprises a base, where the base is comprised of two end units, a lower support, where the lower support is removably secured to the base, a middle, where the middle is removably connected to, and located above, a lower connection section, and where the middle section is removably connected to, and located below, and upper connection section, and where a top end unit is located above, and removably connected to, the upper connection section, where at least the lower support, the middle section, and the upper support have at least one slat wall cutout, where the at least one slat wall cutout can removably retain the slat wall insert to allow for merchandising of one or more items on a surface of the columns, where no part of the display is wider than 48" and not part of the display is longer than 48", such that all the parts of the display will fit on a 44"×48" pallet.

17. A bridge assembly, comprising a bridge shelf with two ends, where each end has two holes located on an underside portion of each of the two ends, and two brackets, where each has two prongs that mate with the two holes in the underside portion, and where each bracket has an insert portion that mates with a bridge unit slot such that the bridge shelf extends from a first bridge unit to a second bridge unit, where the bridge assembly is a modular trade show display with interlocking slots, comprising a column, where the column comprises four end units, four bridge units and two middle units, where each end unit has an end unit end and two end unit slots, where each bridge unit has a bridge unit top end and a bridge unit bottom end, and where each bridge unit has four bridge unit slots, with two bridge unit slots at the bridge unit top end and two bridge unit slots at the bridge unit bottom end, and where each middle unit has a middle unit top end and a middle unit bottom end, and where each middle unit has four middle unit slots, with two middle unit slots at the middle unit top end and two middle unit slots at the middle unit bottom end, and where each of the end unit slots removably slot into one of the bridge unit slots, and each of the middle unit slots removably slot into at least one of the bridge unit slots, where two end units are aligned parallel in a first direction to each other to form a base, and two end units are aligned parallel in the first direction to each other to form a top, and the two middle units are aligned parallel in the first direction for form a middle, and two of the bridge unit are aligned in a second direction to form a lower support, and two of the bridge units are aligned in the second direction to form an upper support, and where the first direction is perpendicular to the second direction, and where the column comprises, in a sequence, from a column bottom to a column top, two end units, two bridge units, two middle units, two bridge units, and two end units, such that all of the end units are parallel to the two middle units, and all four of the bridge units are parallel to the other bridge units, additionally comprising a second column and a backwall, where the backwall is connected to the first column and to the second column, such that there are two columns, where the second column is an identical to the first column, where the second column also comprises four end units, four bridge units and two middle units.

* * * * *